US005267617A

United States Patent [19]

Perricone et al.

[11] Patent Number: 5,267,617

[45] Date of Patent: Dec. 7, 1993

[54] DOWNHOLE TOOLS WITH INFLATABLE PACKERS AND METHOD OF OPERATING THE SAME

[75] Inventors: James M. Perricone, Spring; John T. Lembcke, Houston, both of Tex.

[73] Assignee: Petro-Tech Incorporated, Houston, Tex.

[21] Appl. No.: 934,942

[22] Filed: Aug. 24, 1992

Related U.S. Application Data

[63] Continuation-in-part of Ser. No. 742,633, Aug. 8, 1991, abandoned.

[51] Int. Cl.[5] ..... E21B 33/122

[52] U.S. Cl. ..... 166/387; 166/187; 166/191

[58] Field of Search ..... 166/191, 250, 187, 312, 166/386, 387

[56] References Cited

U.S. PATENT DOCUMENTS 2,741,313 4/1956 Bagnell ..... 166/186
4,535,843 8/1985 Jageler ..... 166/191 X
4,566,535 1/1986 Sanford ..... 166/191
4,815,538 3/1989 Burroughs ..... 166/187 X
4,869,324 9/1989 Holder ..... 166/387
4,913,231 4/1990 Muller et al. ..... 166/187
4,962,815 10/1990 Schultz et al. ..... 166/191 X

*Primary Examiner*—Thuy M. Bui
*Assistant Examiner*—Frank S. Tsay
*Attorney, Agent, or Firm*—Vaden, Eickenroht, Thompson, Boulware & Feather

[57] ABSTRACT

A straddle packer is disclosed using two inflatable packing elements mounted on a mandrel. After the packing elements are inflated, the mandrel can be moved relative to the packing elements to various positions to sample, test, treat, etc. the formation. Resilient connecting means between the mandrel and the packer require a substantial force that is detectable at the surface to move the mandrel to another position. A pin and J-slot control the movement of the mandrel relative to the packer and limit the movement so that a substantial increase in force at the surface indicates that the mandrel is properly positioned.

11 Claims, 9 Drawing Sheets

DOWNHOLE TOOLS WITH INFLATABLE PACKERS AND METHOD OF OPERATING THE SAME

This application is a continuation-in-part of Ser. No. 07/742,633, filed Aug. 8, 1991 and entitled DOWNHOLE TOOLS WITH INFLATABLE PACKERS AND METHOD OF OPERATING THE SAME, abandoned.

This invention relates to downhole tools for acidizing, fracturing, perforation washing, flow testing, reservoir and hydrological testing, squeeze cementing, and the like and a method of operating the tools. The tools are usually run into the well casing on tubing and are particularly useful for running on small diameter coil tubing into the production tubing of wells being worked over or tested.

Inflatable packers have been used with downhole test tools, squeeze tools, and straddle packers for isolating the formation to be treated or tested as evidenced by the following United States patents: Bagnell, U.S. Pat. No. 2,741,313; Jageler, U.S. Pat. No. 4,535,843; Sanford, U.S. Pat. No. 4,566,535; Brisco, U.S. Pat. No. 4,569,396; Burroughs, U.S. Pat. No. 4,815,538; Holder, U.S. Pat. No. 4,869,324; Muller et al, U.S. Pat. No. 4,913,231, and Schultz et al, U.S. Pat. No. 4,962,815. Only Muller et al and Schultz et al are material to the invention described herein.

Both of these patents employ a mandrel with longitudinally spaced inflatable packing elements mounted on the mandrel. The mandrel is reciprocated relative to the packing elements between various positions such as a position for inflating and deflating inflatable packing elements, an isolating position for trapping the fluid in the packing elements, and an injection/receiving position to allow fluid to flow into and out of the mandrel. A lug or pin and J-slot control the movement of the mandrel relative to the packing elements. The mandrel is moved from position to position by adjusting the force the tubing exerts on the mandrel.

Simply adjusting the force as shown on the weight indicator at the surface may or may not change the position of the mandrel relative to the packers several thousand feet below the surface in a well bore that is rarely straight or vertical throughout its length. Wells drilled offshore are usually inclined from the vertical. Tubing in these wells will lie against the low side of the hole and it is impossible to determine how much the end of the tubing string moves when the upper end of the tubing is moved up or down at the surface.

Also affecting the operation of the Muller et al and Schultz et al tools is the type of packers they use. Conventional inflatable packers will begin to move under a force of about 2,000 lbs. As a result, with these tools a positive surface indication of the position of the mandrel relative to the packers cannot be obtained by pulling up or sitting down weight on the tubing because any significant weight change could move the entire tool.

Therefore, it is an object of this invention to provide a straddle packer employing two or more longitudinally spaced, independently operated inflatable packer assemblies for treating, squeezing, cementing, testing, and the like that, when the packers are set, will provide positive indications at the surface of the position of the mandrels of the packer assemblies relative to the inflatable packing elements.

It is a further object of this invention to provide such a straddle packer having two or more inflatable packing assemblies, each of which can resist 15,000–17,000 lbs. of force without moving thereby allowing a significant force to be applied to the tubing at the surface to confirm that the mandrels have moved to the next position in the operating sequence.

It is a further object and feature of this invention to provide an inflatable packer assembly carried by a mandrel having a pin and J-slot to control the relative movement between the packer assembly and the mandrel with the pin and J-slot stopping further relative movement between the packer and the mandrel in one direction when the mandrel has moved from one position to another allowing confirmation to be indicated at the surface by a sharp increase in the force applied to the mandrel.

It is another object and feature of this invention to provide a straddle packer assembly for running on coil or other tubing and sealing off a section of the tubing comprising, a pair of longitudinally spaced, independently operated, inflatable packer assemblies, tubular spacer means extending between and connected to the packer assemblies to hold the packer assemblies a predetermined distance apart, each packer assembly including a mandrel connected to one end of the tubular spacer means, an inflatable packing element mounted on the mandrel, said packing element having tabs for engaging the tubing to hold the packer assembly against longitudinal movement relative to the tubing when the packing element is inflated and the packer assembly is subjected to substantial longitudinal forces, and upper and lower packer heads, said mandrel having packer inflating and deflating ports and an injection/receiving port in the upper packer mandrel through which fluid can flow into and out of the mandrel between the packer assemblies, an injection/receiving port in one of the packer heads, and means connecting the packer assembly to the mandrel for relative movement of each mandrel and the packer assembly mounted thereon between a first position when fluid under pressure can flow directly from the mandrel through each inflating-/deflating port into each inflatable packer to inflate and force each packing element into sealing engagement with the tubing with sufficient force for each packer assembly to resist movement relative to the tubing, a second position where the packer inflating fluid is trapped in each inflatable packing element, a third position where fluid can be pumped through the injection/-receiving ports of the mandrel and packer head into the formation or formation fluid can flow through the ports into the mandrel, a fourth position closing the injection/receiving port, and back to the first position to allow the inflating fluid to flow out of the packing elements into the mandrels to deflate the packers and release the straddle packer tool for removal by the tubing, said connecting means including resilient means for holding the mandrels from moving from a given position until a substantial longitudinal force is exerted on the mandrels to overcome the holding force of the resilient holding means thereby giving a surface indication when the resistance of the holding means has been overcome and the mandrels have moved to the next position.

It is a further object of this invention to provide such a straddle packer in which the connecting means of each inflatable packer assembly includes a set of three longitudinally spaced annular grooves in the mandrel, a collet attached to each packer, and each collet having a plurality of spring fingers with a lug attached to each finger and urged into one of the grooves by the spring fingers to hold the mandrel from movement relative to the packer assemblies until sufficient force is exerted on the mandrel to cam the lugs outwardly far enough to allow the mandrel to move longitudinally to another position with the lugs engaging another of the grooves.

It is a further object of this invention to provide such a straddle packer in which a groove in the mandrel and a pin attached to a packer head and extending into the groove to guide the mandrels of both packer assemblies to the four positions of the mandrel relative to the packer assemblies and to limit the movement of the mandrels relative to the packer assemblies after the mandrel has moved to the next position.

None of the straddle packers described in the patents listed above use two longitudinally spaced, independently operated, inflatable packer assemblies thereby allowing the two packer assemblies to be spaced apart any desired distance using one or more pup joints to connect the mandrels of the packer assemblies and it is another object of this invention to provide such a straddle packer.

These and other objects, advantages, and features of this invention will be apparent to those skilled in the art from a consideration of this specification, including the attached drawings and appended claims.

In the Drawings

Figure 7A:
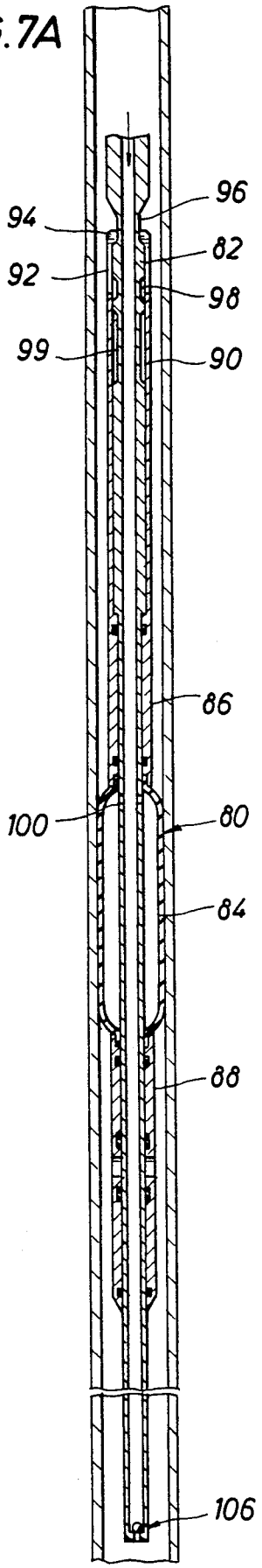
Figure 7B:
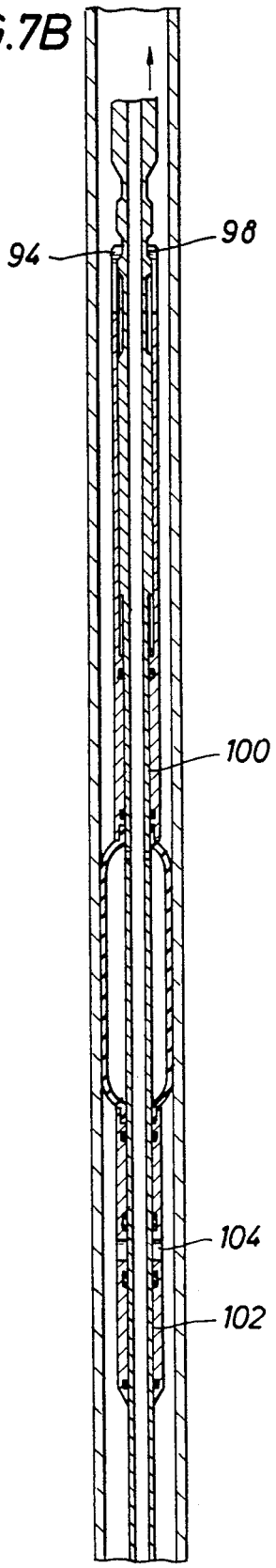
Figure 7C:
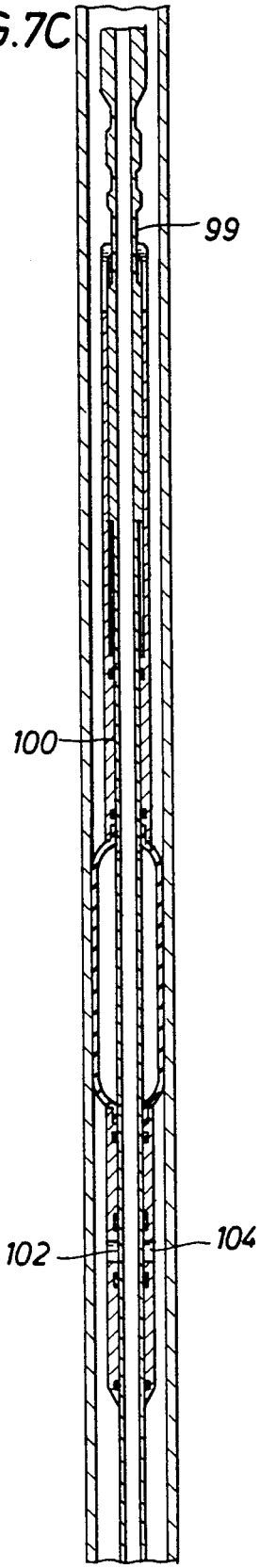

FIGS. 7A, 7B, and 7C are vertical sectional views of a 16 packer that can be used as a downhole test tool, a squeeze tool, or the like employing only one inflatable packing element with all of the features of one of the inflatable packer assemblies of the straddle packer described above except the pin slot arrangement.

Figure 8A:
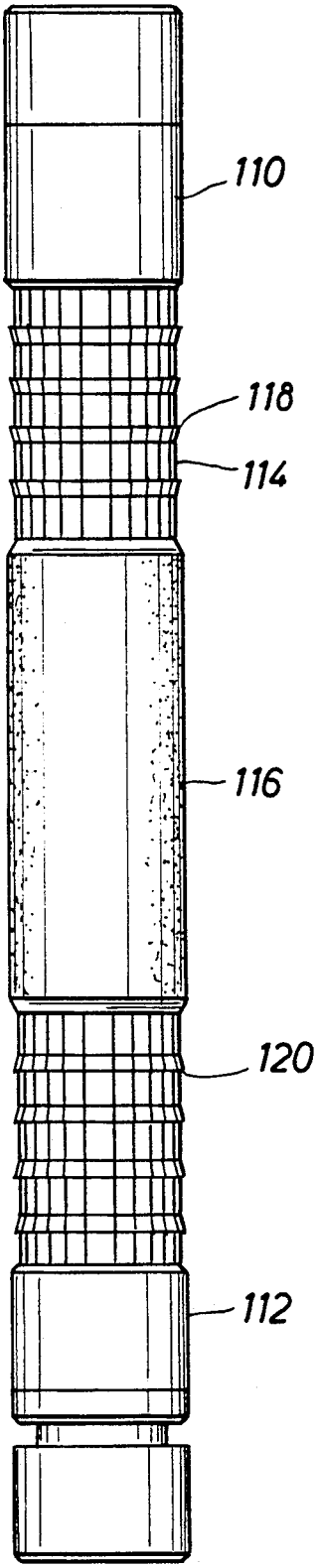
Figure 8B:
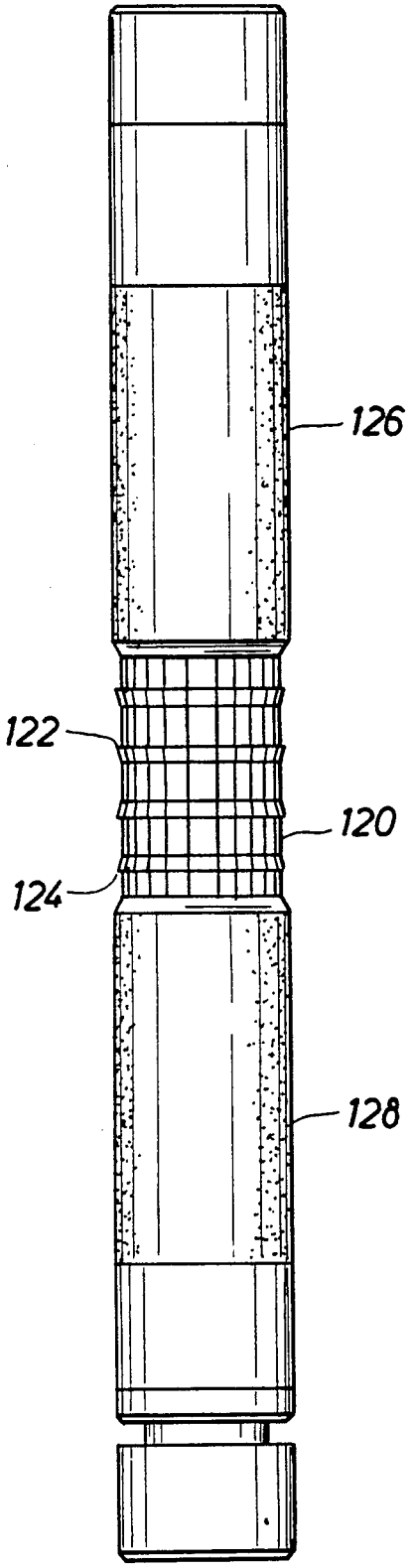

FIGS. 8A and 8B are views in elevation of inflatable packing elements designed to resist longitudinal movement relative to the tubing or casing in which they are set.

FIGS. 1A-4B serve to illustrate the various positions of the straddle packer that can be obtained by vertical movement of the tubing to which it is attached.

The invention will be described as being used with coil tubing although the packer of this invention can be designed to run on conventional tubing and set in relatively large diameter casing.

In FIGS. 1A-4B, the packer is shown positioned inside production tubing string 16. The basic components of the straddle packer are two longitudinally spaced, independently operated inflatable packer assemblies 20 and 22. The inflatable packer assemblies consist of inflatable packing elements **24*a* and 24*b*, upper packer heads 26*a* and 26*b*, and lower packer heads 28*a* and 28*b*. Mandrels 18*a* and 18*b* have inflating and deflating ports 30*a* and 30*b* that are located in position in FIGS. 1A and 1B to supply fluid under pressure directly to inflate packing elements 24*a* and 24*b***.

At least one of the mandrels and one of the packer heads between the two packing elements are provided with injection/receiving ports that in one position of the packer will be aligned to allow fluid to flow from the mandrel having the ports into the annulus between the packer and the tubing or fluid can flow from the annulus through the ports into the mandrel depending upon how the packer is being used. In the embodiment shown, mandrel injection/receiving port 32 is located in mandrel **18*a* below packing element 24*a*. Injection/-receiving port 34 is located in lower packer head 28*a* of the upper packing assembly. Appropriate seals indicated by the letter "S" are provided to isolate these ports from each other except when the tool is in position 3 where the port in the mandrel is opened to the annulus between the packers and the tubing through port 34 in the lower packer head 28*a***. The seals also serve to trap the inflating fluid in the inflatable packing elements.

Means are provided to connect both packer assemblies to their mandrels for relative movement of the mandrels and the packer assemblies between a first position, where fluid under pressure can flow directly from the mandrels through the inflating/deflating ports into the inflatable packing elements to inflate and force the packing elements into sealing engagement with the production tubing with sufficient force for the packing assemblies to resist movement relative to the tubing or casing in which they are set, a second position where the packer inflating fluid is trapped in the inflated packing elements, a third position where fluid can be pumped through the injection/receiving ports of one of the mandrels and one of the packer heads into the formation or formation fluid can flow through the ports into the mandrel, and a fourth position closing the injection/receiving ports. Then back to the first position to allow the inflating fluid to flow out of the inflatable packing elements into the mandrels to deflate the packing elements and release the straddle packer tool for removal by the tubing or relocation of the tool to repeat the process.

In the embodiment shown, such connecting means include resilient means for holding the mandrels from moving from a given position until a substantial longitudinal force is exerted on the mandrels to overcome the holding force of the resilient holding means and to give a surface indication when the resistance of the holding means has been overcome. In the embodiment shown, the holding means include three annular grooves 36*a*, 38*a*, and 40*a* located in mandrel 18*a*, adjacent the upper end of the tool, annular grooves 36*b*, 38*b*, and 40*b* located in mandrel 18*b* above the lower packer assembly, and collets 42*a* and 42*b* that are attached to upper packer heads 26*a* and 26*b* of the packer assemblies. The collets have a plurality of spring fingers 44*a* and 44*b*. The fingers have lugs 46*a* or lugs 46*b* on their ends that are designed to engage annular grooves in the mandrels to hold the mandrels and the packer assemblies in various positions relative to each other to perform the desired functions. The spring fingers hold the lugs in the grooves and resist movement out of the grooves by a force that is a function of the angle of the engaging surfaces on the lugs and the grooves. The walls of the grooves and the sides of the lugs are tapered in a direction to provide a component of the upward or downward force supplied by the tubing that will tend to urge the lugs out of the grooves. Preferably, the force required to move the mandrels downwardly relative to the collets is less than that required to move the mandrel upwardly because with coil tubing, it is desirable to keep the compressive force imposed on the tubing to a minimum.

Figure 1A:
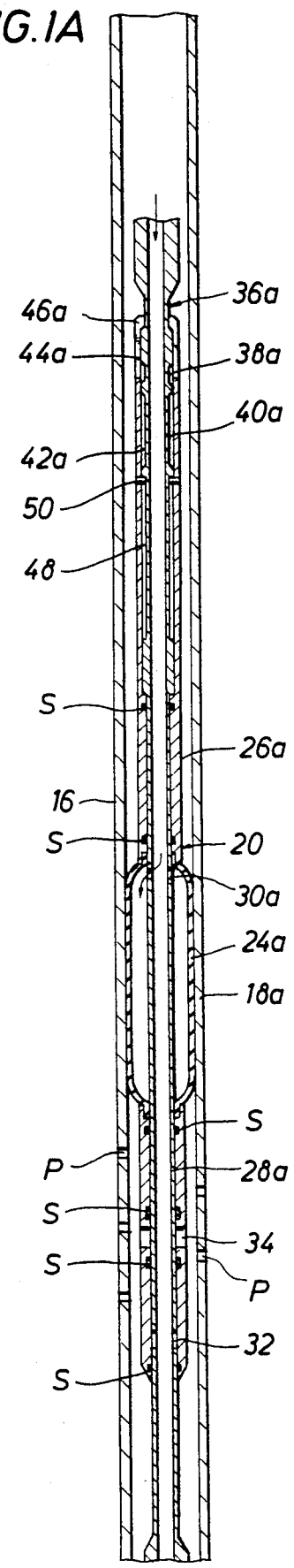
FIGS. 1A and 1B are vertical sectional views of the straddle packer of this invention having two longitudinally spaced, independently operated, inflatable packer assemblies shown in position for inflating the packing elements of each packer assembly through the inflating-/deflating ports in the mandrel of each packer assembly to set the packer.
Figure 1B:
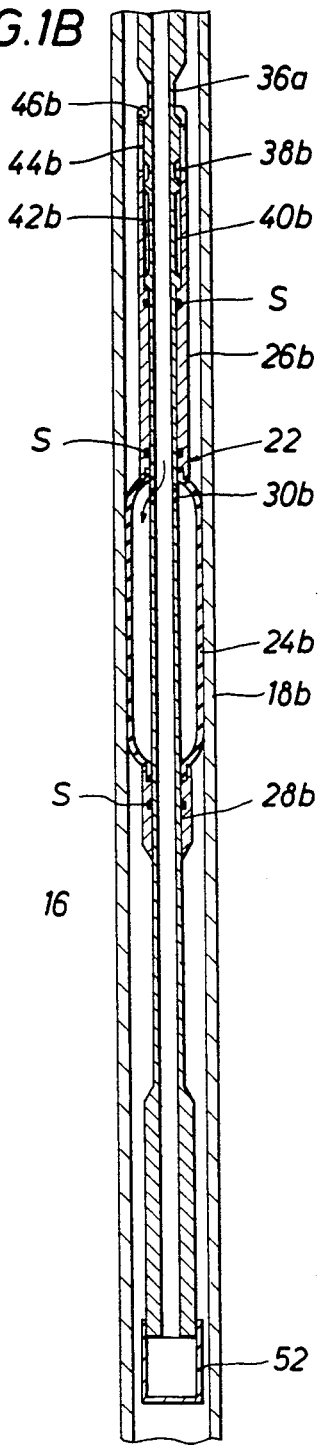
Figure 2A:
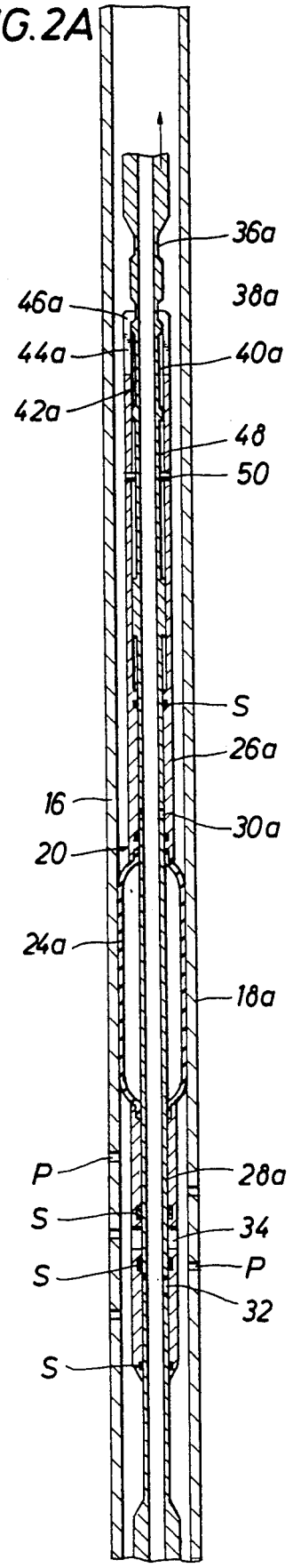
FIGS. 2A and 2B show the straddle packer of FIGS. 1A and 1B with the mandrels of each packer assembly moved to a position to trap the inflating fluid in the inflatable packers to hold the inflatable packers in sealing engagement with the production tubing or casing.
Figure 2B:
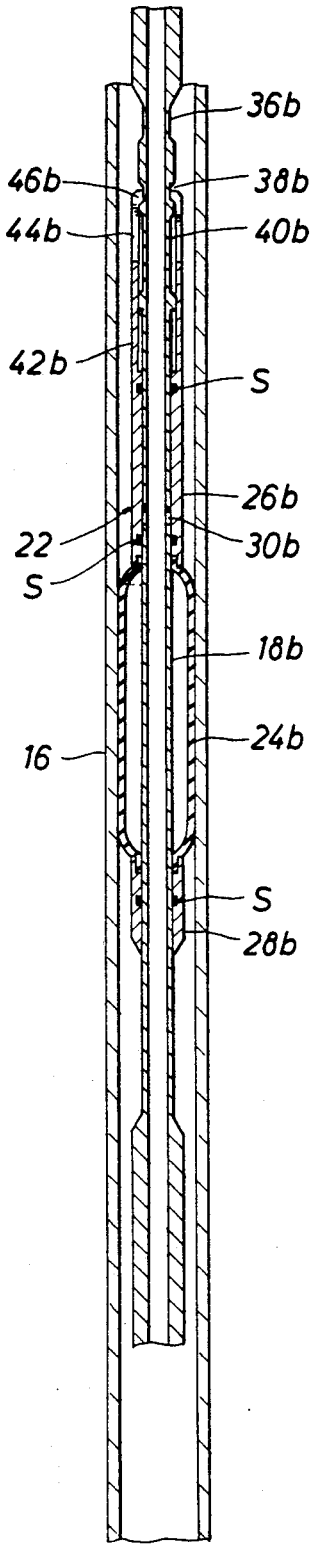
Figure 3A:
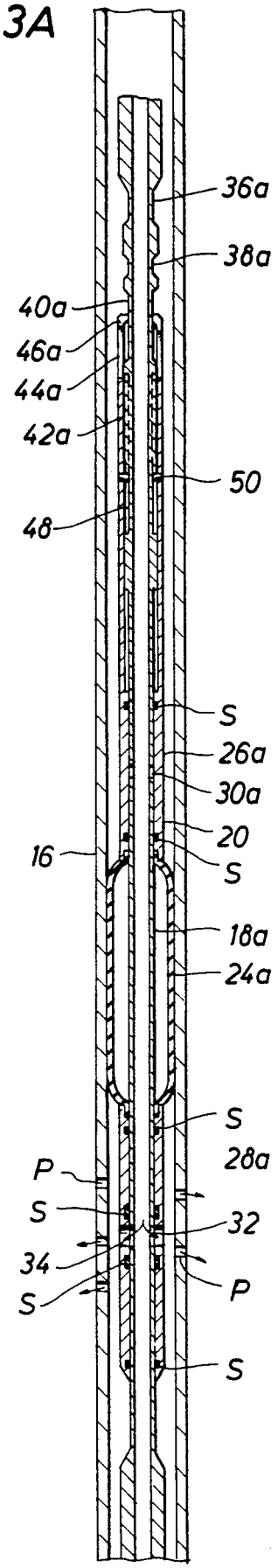
FIGS. 3A and 3B show the straddle packer in the third position with the injection and receiving ports of the mandrel of the upper packer and the ports in the upper packer body or head in alignment to allow fluid to flow from the mandrel into the annulus between the straddle packer and the tubing and for fluid to flow in the opposite direction if the tool is being used as a flow test tool.
Figure 3B:
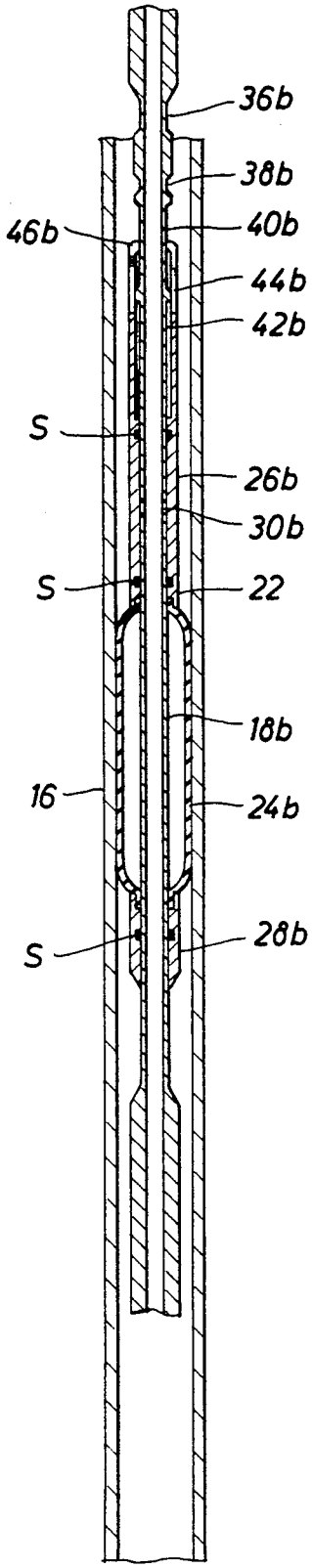
Figure 4A:
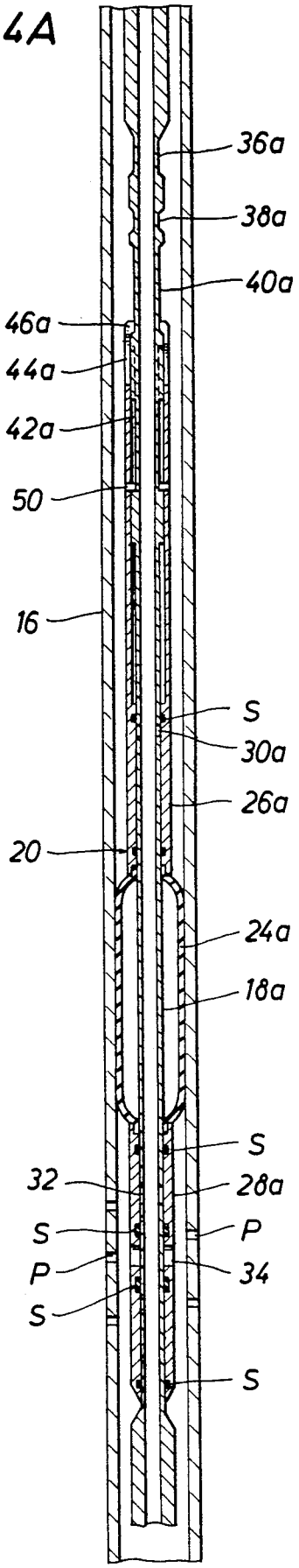
FIGS. 4A and 4B show the straddle packer with the mandrels moved to the fourth position closing the receiving/injecting port in the upper packer mandrel by moving it out of fluid communication with the port in the lower packer head of the upper packer.
Figure 4B:
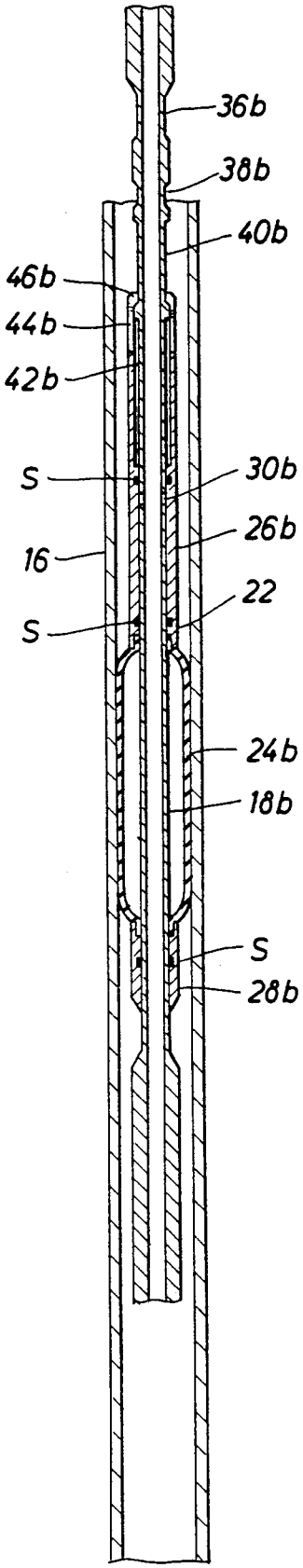
Figure 5A:
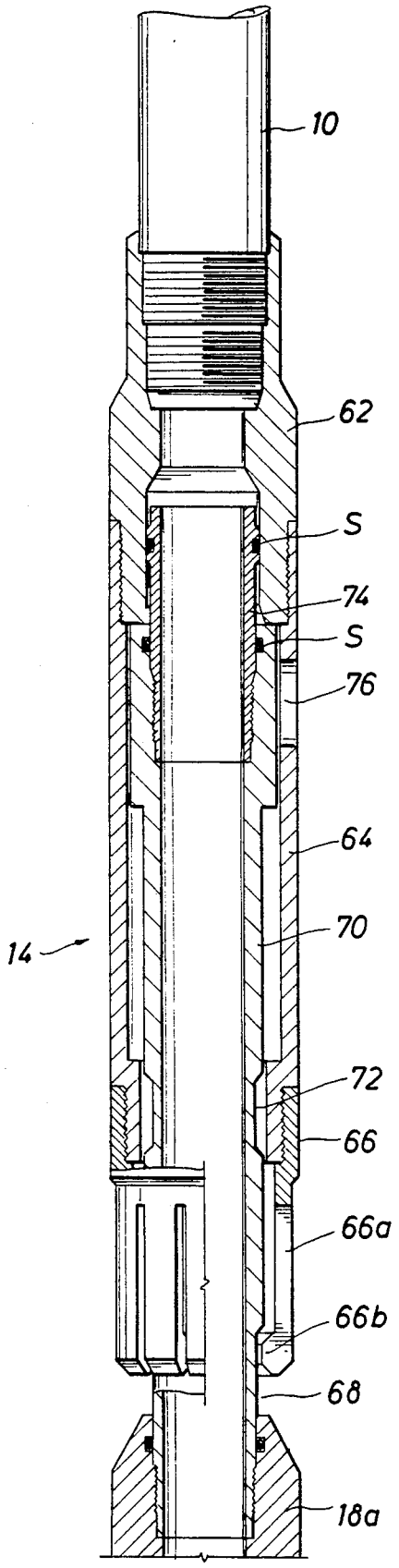
FIGS. 5A-5G are sectional views on an enlarged scale of the straddle packer shown in FIGS. 1A-4B plus a circulating valve.
Figure 5B:
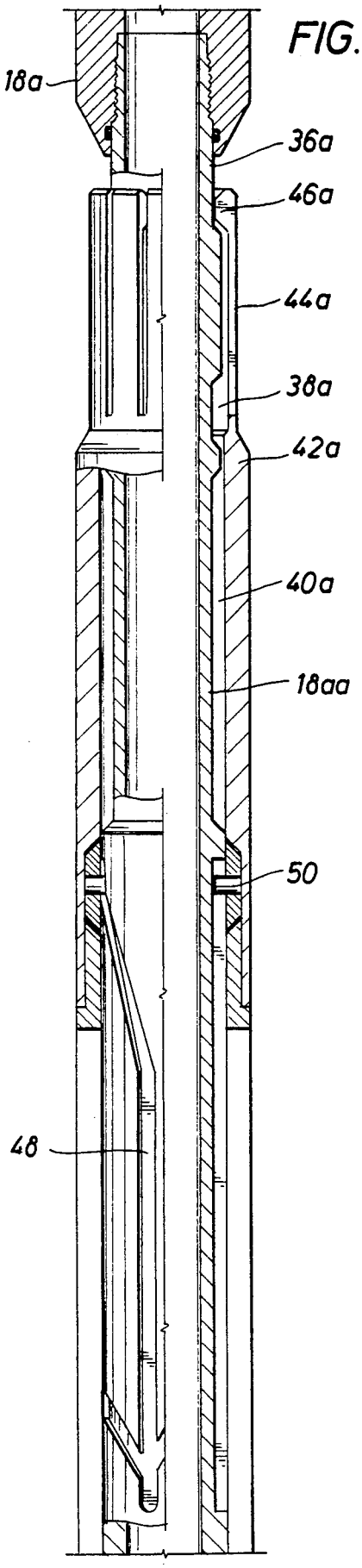
Figure 5E:
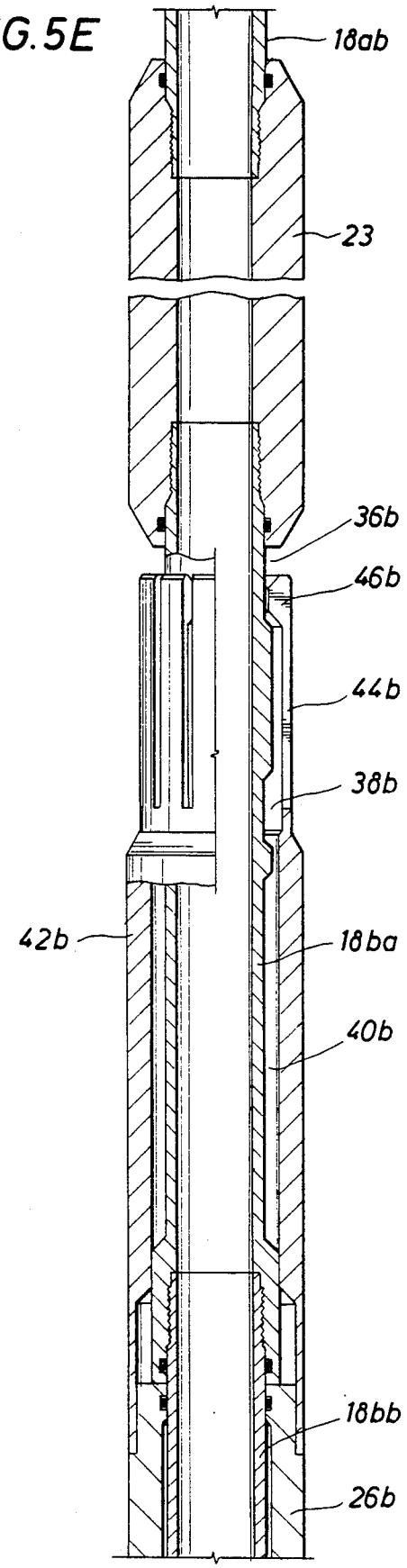
Figure 5F:
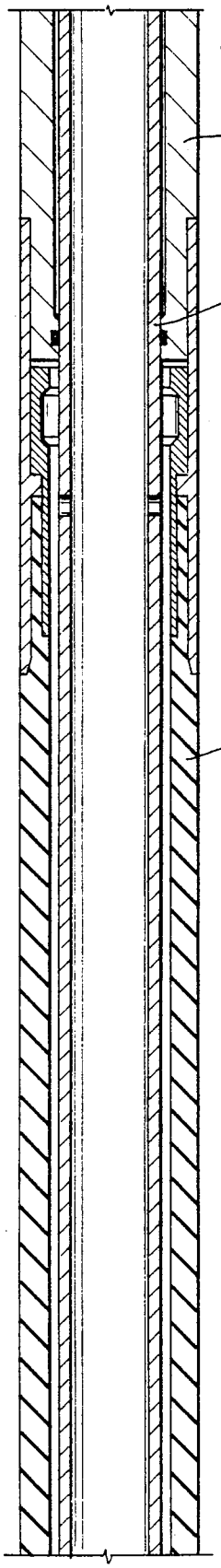
Figure 5C:
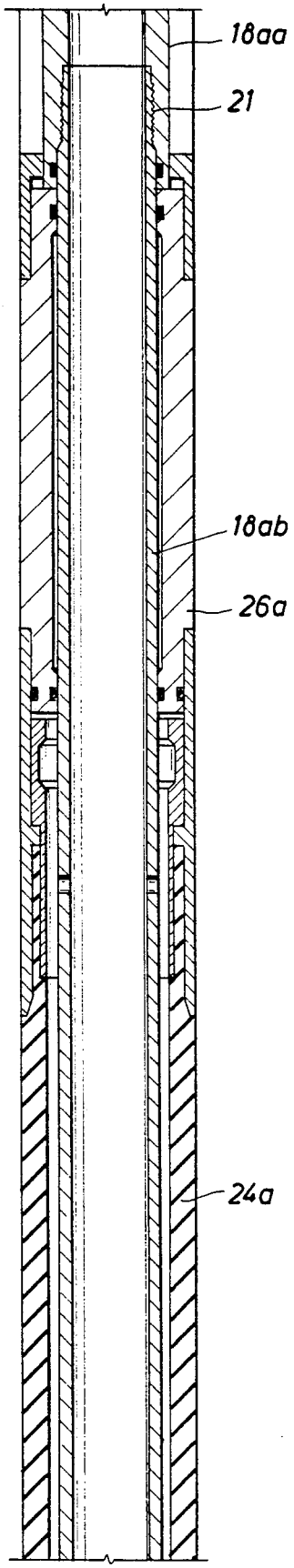
Figure 5D:
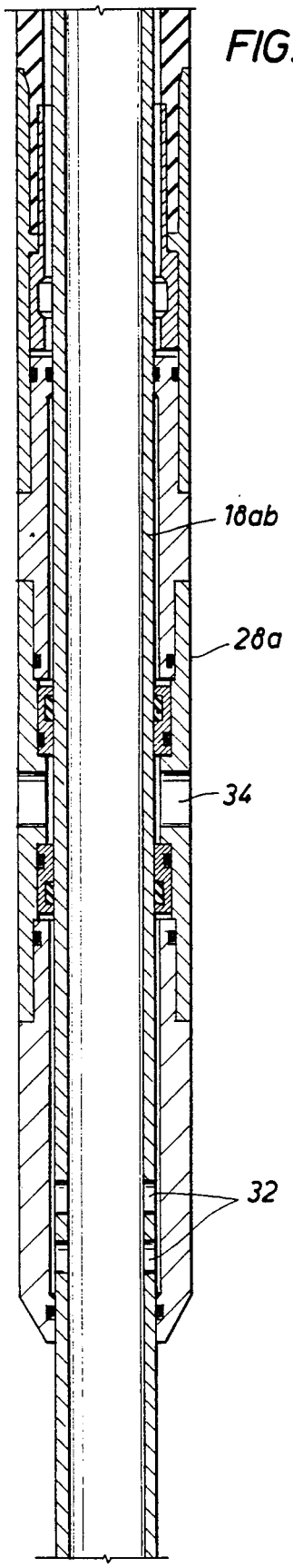
Figure 5G:
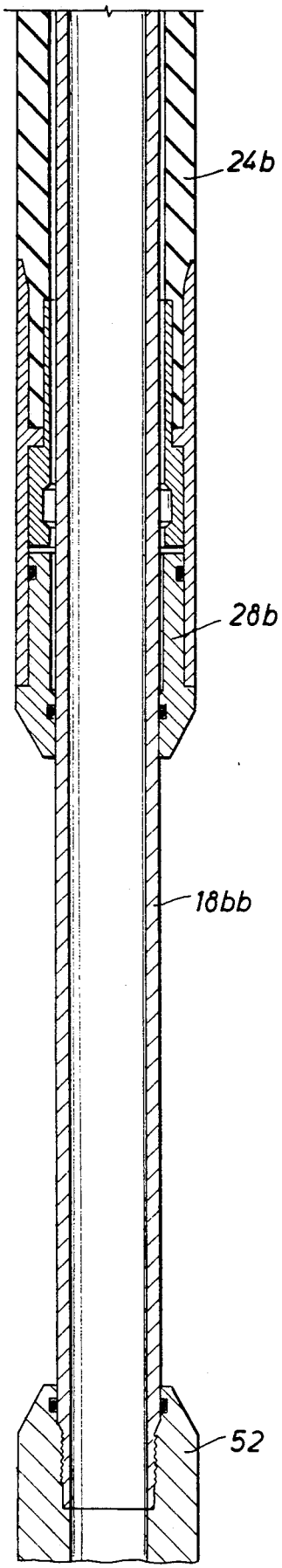
Figure 6:
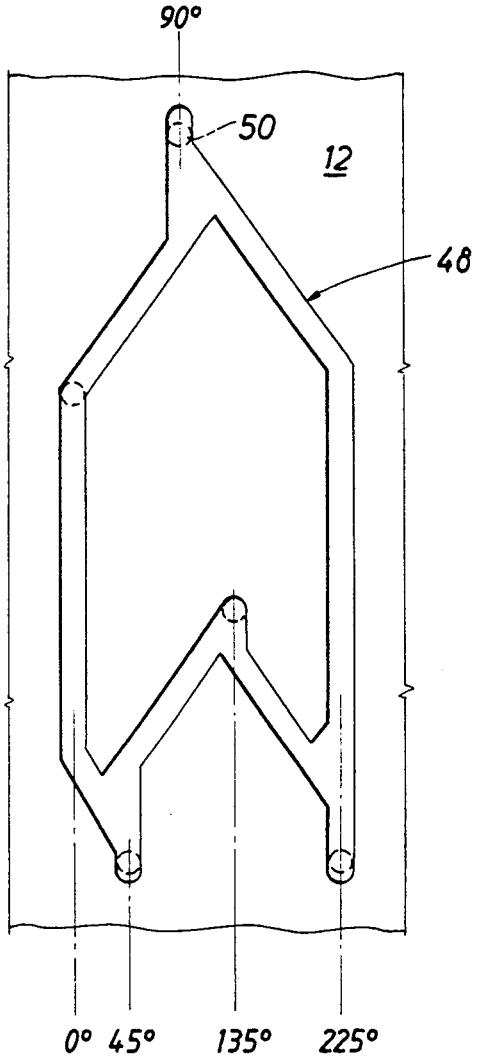
FIG. 6 is a plan view of the pin slot arrangement employed with the straddle packer of FIGS. 1-5.

The relative movement between the collets and the mandrels is controlled by groove or slot 48 in the external surface of mandrel 18*a* and pin 50 mounted in upper packer head 26*a*. The path followed by the pin in the slot is shown in FIG. 6. In position 1, the relationship of the packer assemblies and the mandrel is as shown in FIGS. 1A and 1B. Pin 50 is at the upper end of slot 48 and the mandrels are positioned for packer inflating ports 30*a* and 30*b* to be located so that pressure fluid can be pumped down the mandrels through the ports and inflate the packers, as shown in FIGS. 1A and 1B. When the packers have been inflated to the extent where they are in sealing engagement with the walls of the tubing or casing, or if it is an open hole with the wall of the well bore, the packer assemblies will be firmly held against longitudinal movement. An inflatable packer specifically designed to hold an inflatable packing element against such longitudinal movement is described in U.S. Pat. No. 4,892,144, entitled "Inflatable Tools" that issued Jan. 9, 1990, which patent is incorporated herein by reference. Two embodiments of the packers are shown in FIGS. 8A and 8B and will be described below.

In position 1, as described above, lugs 46*a* and 46*b* on the collet fingers are in engagement with grooves 36*a* and 36*b* on the mandrel. To move the mandrels so that packer inflating ports 30*a* and 30*b* are moved to a position where they cannot further communicate with the fluid in the inflated packers, the mandrels are pulled upwardly with sufficient force to cause the spring fingers of the collets to move outwardly and allow the lugs to move into engagement with grooves 38*a* and 38*b*. This is the position shown in FIGS. 2A and 2B. The pressure in the mandrels can now be released and the inflating fluid pressure in the packers will be trapped.

To establish communication between the mandrels and the annulus between the packers, the mandrels are moved upwardly to position 3, which requires the lugs on the collets to be moved from grooves 38*a* and 38*b* to grooves 40*a* and 40*b*. This groove is much longer than the other grooves to allow the mandrel to move upwardly until the pin engages the bottom of the groove in position 4, as shown in FIG. 6, to give a surface indication that the movement has taken place because the upward movement of the mandrels will be stopped by the packers causing a sharp increase in the force being exerted at the surface. Thereafter, the mandrel is lowered and the pin will follow the groove to position 3, as shown in FIG. 6. This will locate the lugs about midway between the end walls of grooves 40*a* and 40*b*. Here again there will be a surface indication of this because the mandrels will be held against further downward movement once it reaches position 3.

In this position, the injection/receiving port 34 in packer head 28*a* is in alignment with injection/receiving port 32 in mandrel 18*a* and fluid can be received into the mandrel or injected out of the mandrel depending upon the particular job the packer is being used to accomplish. Specifically, acid can be injected through the ports and through the perforations in the tubing into the formation. Cement can be squeezed etc. Alternatively, if the straddle packer is to be used for testing the formation, then the pressure in the mandrels can be reduced to allow formation fluids to enter the mandrels to act against instruments located in the mandrels for measuring formation pressure and the fluid can be trapped in the mandrels and tubing and brought to the surface by closing ports 34.

After the job is completed, the mandrels are raised to move the pin to position 4 again giving a surface indication that the mandrel is in the desired position. Injection/receiving port 32 in mandrel 18*a* is now moved above the seals around injection/receiving port 34 in the packer head and the mandrels will again be closed to the annulus. The mandrels can then be lowered to move the pin to position 1, as shown in FIG. 6, and return the packer assemblies and the mandrels to the position shown in FIGS. 1A and 1B to allow the pressure in the packing elements to be released. The tool is now free to be pulled out of the tubing. In returning the tool to position 1, injection/receiving port 32 in the mandrel will pass injection/receiving port 34 in packer head 28*a*, briefly opening the mandrels to communication with the annulus. This condition will exist for such a short period of time that it is not considered a problem even if a sample of well fluid is in the mandrels.

In order to apply pressure to the inflatable packers of this tool, mandrel 18*b* must be closed below the packing elements. This can be done in several ways. In FIG. 1B, the lower end of mandrel 18*b* is shown closed by bull plug 52 A check valve, such as a float valve, can also be used.

In FIGS. 5A–5G, the straddle packer shown in FIGS. 1A–4B is shown in greater detail. The mandrels, which were indicated by the numbers 18*a* and 18*b* in FIGS. 1A–4B, are, of course, made up of several connected members in FIGS. 5A–5G. Therefore, various parts of each mandrel will be indicated by letters 18*a* or 18*b* to identify the mandrel followed by the letters a, b..

Thus, upper connector 19 connects upper mandrel section 18*aa* that extends through the upper portion of the packer to circulating valve 14. The lower end of mandrel section 18*aa* is connected to mandrel section 18*ab* by threads 21. The lower end of section 18*ab* is then connected to the upper end of section 18*ba* of the mandrel of the lower packer assembly through connector 23. This connector can be anything from a short coupling to one or more pup joints that are used to space the packer assemblies a predetermined distance apart. The rest of the mandrel of the lower packer assembly consists of section 18*bb*.

In addition to showing the structure of the two packer assemblies in FIGS. 5A-5G, FIG. 5A includes circulating valve 14 attached to the upper end of the mandrel. Sub 62 connects outer housing 64 of the valve to coil tubing string 10. Collet 66 is connected to the lower end of housing 64. The collet has fingers 66*a* and lugs 66*b*. The lugs are shown engaging groove 68 at the lower end of inner housing member 70. The groove actually consists of a section of reduced diameter and the upper end of mandrel coupling 18*a*. Above this groove is groove 72 in the outer surface of inner housing member 70. Sleeve 74 is mounted in the upper end of inner housing 70 and extends into the bore of sub 62. Seals carried by the upper end of the sleeve and seals located adjacent the upper end of inner housing 70 confine the fluid flowing downwardly through the valve to the bore of the valve, when the members are in the position shown in FIG. 5A.

From time to time, there will be a need to circulate fluid down tubing 10 and up the annulus between the tubing and the production string in which it is located or vice versa. For example, if the straddle packer is being used to acidize a formation or to squeeze cement into the formation after the packer is set, circulating valve 14 can be opened and the cement or acid can be pumped to the top of the circulating valve, after which the valve is closed and pressure applied to the acid or cement. Then the valve can be opened and the excess acid or cement can be pumped back to the surface through the tubing string using reverse circulation.

To open the valve, an upward pull on outer housing 64 by the coil tubing will cause collet lugs 66*b* to move from groove 68 to groove 70. This moves sub 62 to a position where the lower end of the sub is well above the upper end of sleeve 74 and out of contact with the seal carried by the sleeve. Fluid can now flow between coil tubing string 10 and the annulus through port 76. The valve is closed by exerting a downward force on the tubing sufficient to move lugs 66*b* on the collet fingers out of groove 70 and back into groove 68. Since it is desirable to keep the compressive force exerted on the tubing to a minimum, the angles on the lugs and the ends of the groove should be such that very little force is required to close the valve. The force required to open the valve should be substantially greater than the force required to move the mandrels upwardly in the operation of the straddle packer. Otherwise, the upward force applied to move the mandrels upwardly may well open the circulating valve.

FIGS. 7A-7C illustrate a drill stem test tool employing one of the inflatable packer assemblies described above and generally indicated by the number 80. The packer assembly includes mandrel 82, inflatable packer 84, upper packer head 86, and lower packer head 88. Means are provided to move the mandrel relative to the packer assembly between a position for inflating packing element 80, to a position where the inflating fluid is trapped inside the packing element so that the pressure inside the mandrel can be released, and to a position opening the mandrel for fluid communication with the producing formation.

The means employed in the preferred embodiment shown in FIGS. 7A-7C is substantially the same as that employed in the straddle packer described above except that the upper packer head is not connected to the mandrel by a pin and groove assembly. This feature is not used in the downhole test tool because it is desirable to be able to open and close the tool without having to go through the packer deflating and inflating positions. Therefore, packer head 84 is provided with collet 90 having spring fingers 92 equipped with lugs 94 that engage grooves 96, 98, and 99 in the outer surface of the mandrel.

In the position shown in FIG. 9A, the collet lugs are located in groove 96 and the mandrel is positioned for fluid to be pumped into packing element 84 through port 100 to inflate the packer. In FIG. 2, the mandrel is moved upwardly to shift collet lugs 94 to second groove 98. Packer inflating port 100 is now moved upwardly past the lower seal in the upper housing trapping the inflating fluid in the packer element. Further upward movement of the mandrel moves the collet lugs to groove 99. This moves port 102 in the mandrel into alignment with port 104 in the lower packer head and opens the mandrel to fluid communication with the formation being tested.

The lower end of the mandrel is closed by ball check valve 106 as shown in FIG. 7A. Other means could be used. Whatever instruments are required to measure downhole pressure, changes of pressure, temperature, etc., can all be located in the mandrel. As stated above, the pin and slot arrangement are not used in this tool because it is desirable to be able to move between positions 2 and 3 a number of times before the packer is deflated and the tool removed from the well bore.

To allow the resilient holding means to require a substantial force to be exerted on the mandrel before the holding means will release, the force required to move the inflated packers must be more than substantial. The inflatable packers shown in FIGS. 8A and 8B and described in detail in U.S. Pat. No. 4,892,144 require a very substantial amount of force to move them. Seventeen thousand pounds, for example, in the 1 11/16' diameter size and more as the diameter increases. The force required to move conventional inflatable packers is about nine hundred pounds for the small diameter packers up to about two thousand pounds for the larger sizes.

The packer shown in FIG. 8A includes upper head 110 and lower head 112, an inner sleeve of elastomeric material (not shown) and a plurality of overlapping strips 114 extending longitudinally between the heads in which the ends of the strips are anchored. Outer sleeve 116 of elastomeric material is located about midway between the heads. The strips have a plurality of tabs 118 that are bent out of strips 114 in spaced circles between sleeve 116 and upper head 110. The tabs are designed to bite into the wall of the tubing or casing in which the packer is located and hold the packer from upward movement. Tabs 120 are bent out of the strips below sleeve 116 to bite into the tubing wall and hold the packer from downward movement.

The packer shown in FIG. 8B differs in that the center portion of the strips 122 is exposed and upper tabs 124 hold against upward movement and tabs 126 hold against downward movement of the packer. Sleeves 126 and 128 of elastomeric material engage the wall of the tubing or casing and provide the required seal.

From the foregoing it will be seen that this invention is one well adapted to attain all of the ends and objects hereinabove set forth, together with other advantages which are obvious and which are inherent to the apparatus and structure.

It will be understood that certain features and subcombinations are of utility and may be employed without reference to other features and subcombinations.

This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

We claim:

1. A straddle packer assembly for running on coil or other tubing and sealing off a section of the tubing comprising, a pair of longitudinally spaced, independently operated, inflatable packer assemblies, tubular spacer means extending between and connected to the packer assemblies to hold the packer assemblies a predetermined distance apart, each packer assembly including a mandrel connected to one end of the tubular spacer means, an inflatable packing element mounted on the mandrel, said packing element having tabs for engaging the tubing to hold the packer assembly against longitudinal movement relative to the tubing when the packing element is inflated and the packer assembly is subjected to substantial longitudinal forces, and upper and lower packer heads, said mandrel having packer inflating and deflating ports and an injection/receiving port in the upper packer mandrel through which fluid can flow into and out of the mandrel between the packer assemblies, an injection/receiving port in one of the packer heads, and means connecting the packer assembly to the mandrel for relative movement of each mandrel and the packer assembly mounted thereon between a first position when fluid under pressure can flow directly from the mandrel through each inflating/deflating port into each inflatable packer to inflate and force each packing element into sealing engagement with the tubing with sufficient force for each packer assembly to resist movement relative to the tubing, a second position where the packer inflating fluid is trapped in each inflatable packing element, a third position where fluid can be pumped through the injection/receiving ports of the mandrel and packer head into the formation or formation fluid can flow through the ports into the mandrel, a fourth position closing the injection/receiving port, and back to the first position to allow the inflating fluid to flow out of the packing element into the mandrels to deflate the packers and release the straddle packer tool for removal by the tubing, said connecting means including resilient means for holding the mandrels from moving from a given position until a substantial longitudinal force is exerted on the mandrels to overcome the holding force of the resilient holding means thereby giving a surface indication when the resistance of the holding means has been overcome and the mandrels have moved to the next position.

2. The straddle packer of claim 1 in which the connecting means of each packer assembly includes a set of three longitudinally spaced annular grooves in the mandrel, a collet attached to each packer, and each collet having a plurality of spring fingers with a lug attached to each finger and urged into one of the grooves by the spring fingers to hold the mandrel from movement relative to the packer assemblies until sufficient force is exerted on the mandrel to cam the lugs outwardly far enough to allow the mandrel to move longitudinally to another position with the lugs engaging another of the grooves.

3. The straddle packer of claim 2 further provided with a groove in the mandrel and a pin attached to a packer head and extending into the groove to guide the mandrel of both packer assemblies to the four positions of the mandrels relative to the packer assemblies and to limit the movement of the mandrels relative to the packer assemblies after the mandrel has moved to the next position.

4. A packer for use on coil tubing for acidizing, fracturing, and the like and for flow, reservoir, and hydrological testing and the like comprising a mandrel, an inflatable packer assembly mounted on the mandrel, said assembly including an inflatable packing element having tabs for engaging the tubing to hold the packer against longitudinal movement relative to the tubing when the packing element is inflated and the packer assembly is subjected to a substantial longitudinal force, and upper and lower packing heads, said mandrel having a packer inflating port and a fluid injection/receiving port, and said lower packing head having a fluid injection/receiving port, and means connecting the packer assembly to the mandrel for movement of the mandrel relative to the packer assembly between a first position where fluid under pressure can flow from the mandrel into the inflatable packer to inflate and hold the packer against the tubing with sufficient force to hold the packer assembly against movement relative to the tubing and fluid can flow out of the packing element into the mandrel to release the packer, a second position trapping the fluid in the packing element, and a third position connecting the fluid injection/receiving ports to allow fluid to flow from the mandrel to the formation or to allow fluid to flow from the formation to the mandrel, and a fourth position closing the injection port, said connecting means including resilient means for holding the mandrel from moving from a given position until a substantial longitudinal force is exerted on the mandrel to overcome the holding force of the resilient holding means and to give a surface indication when the resistance of the holding means has been overcome.

5. The packer of claim 4 in which the connecting means includes three longitudinally spaced grooves in the mandrel, a collet attached to the packer head, the collet having a plurality of spring fingers, a lug attached to each spring finger and held in engagement with one of the grooves by the spring fingers to hold the mandrel from longitudinal movement relative to the packer assembly until sufficient force is exerted on the mandrel to cam the lugs outwardly far enough to allow the mandrel to move longitudinally to another position with the lugs engaging another groove.

6. A straddle packer assembly for running on coil or other tubing and sealing off a section of the tubing, the casing or the well bore, comprising a pair of longitudinally spaced, independently operated, inflatable packer assemblies, each packer assembly including a mandrel, an inflatable packing element and upper and lower packer heads mounted on the mandrel, each mandrel having a packer inflating and deflating port and an injection/receiving port through which fluid can flow into and out of the mandrels, an injection/receiving port in one of the packer heads between the packing elements, and means connecting each packer assembly to the mandrel on which it is mounted for relative movement between a first position when fluid under pressure can flow directly from the mandrels through the inflating/deflating ports into each inflatable packing element to inflate and force the packing elements into sealing engagement with the tubing with sufficient force for the packing assemblies to resist movement relative to the tubing, a second position where the packer inflating fluid is trapped in the packers, a third position where fluid can be pumped through the injection/receiving ports of the mandrel and packer head into the formation or formation fluid can flow through the ports into the mandrel, a fourth position closing the injection/receiving port, and back to the first position to allow the inflating fluid to flow out of the inflatable packing elements into the mandrel to deflate the packing elements and release the straddle packer tool for removal by the tubing, said connecting means including a set of three longitudinally spaced annular grooves in each mandrel, a collet attached to each upper packer head, and each collet having a plurality of spring fingers with a lug attached to each finger and urged into one of the grooves by the spring fingers to hold each mandrel from movement relative to the packer assemblies until sufficient force is exerted on each mandrel to cam the lugs outwardly far enough to allow the mandrels to move longitudinally to another position where the lugs engage another of the grooves.

7. The straddle packer of claim 6 further provided with grooves in one of the mandrels and a pin attached to a packer head and extending into the grooves to guide the mandrels to the four positions of the mandrels relative to the packer assemblies, said pin being positioned at the end of a groove when the mandrels are moved to each position to stop the movement of the mandrel and create a significant increase in the force exerted on the tubing to thereby indicate at the surface that the mandrel is in the desired position.

8. A packer for use on coil tubing for acidizing, fracturing, and the like and for flow, reservoir, and hydrological testing and the like comprising a mandrel, an inflatable packer assembly mounted on the mandrel, said assembly including an inflatable packing element having tabs for engaging the tubing to hold the packer against longitudinal movement relative to the tubing when the packing element is inflated and the packing assembly is subjected to substantial longitudinal forces, and upper and lower packing heads, said mandrel having a packer inflating port and a fluid injection/receiving port, and said lower packing head having a fluid injection/receiving port, and means connecting the packer assembly to the mandrel for movement of the mandrel relative to the packer assembly between a first position where fluid under pressure can flow from the mandrel into the inflatable packer to inflate and hold the packer against the tubing with sufficient force to hold the packer assembly against movement relative to the tubing and fluid can flow out of the packing element into the mandrel to release the packer, a second position trapping the fluid in the packing element, and a third position connecting the fluid injection/receiving ports to allow fluid to flow from the mandrel to the formation or to allow fluid to flow from the formation to the mandrel, and a fourth position closing the injection port, the connecting means including three longitudinally spaced grooves in the mandrel, a collet attached to the packer head, the collet having a plurality of spring fingers, a lug attached to each spring finger and held in engagement with one of the grooves by the spring fingers to hold the mandrel from longitudinal movement relative to the packer assembly until sufficient force is exerted on the mandrel to cam the lugs outwardly far enough to allow the mandrel to move longitudinally to another position with the lugs engaging another groove.

9. A method of operating a straddle packer in a well bore having a pair of longitudinally spaced, independently operated, inflatable packer assemblies with tubular spacer means extending between and connecting the mandrel to position the packer assemblies a predetermined distance apart, each packer assembly including a mandrel, an inflatable packing element having tabs for engaging the wall of the well bore to hold the packer assembly from moving relative to the well bore when the packing elements are inflated and upper and lower packer heads, each packing element being mounted on a mandrel that is movable relative to the packing elements between three positions, each mandrel having inflating/deflating ports for inflating and deflating the packing elements and injection/receiving ports through which fluid can flow into and out of the mandrel, and resilient holding means for resisting the movement of the mandrel from one position to another, the method comprising the steps of inflating each packing element with inflating fluid directly from each mandrel through the inflating/deflating ports to set the inflatable packing elements with the mandrels and packing elements in the first position, exerting a substantial upward force on the mandrel to overcome the holding means and to move the mandrel to the second position where the movement of the mandrel relative to the packing elements is stopped creating a substantial increase in the upward force on the mandrel thereby indicating at the surface that the mandrel has moved to the next position closing the inflating/deflating ports, exerting a substantial upward force on the mandrel to overcome the holding means and to move the mandrel to the third position opening the injection/receiving port in one of the packer heads and one of the mandrels below the upper packing element to allow fluid to flow into or out of the mandrel, and moving the mandrel back to the first position opening the inflating/deflating ports to allow the inflating fluid to flow out of the packing element directly into the mandrels to deflate the packing elements and release the packer.

10. The method of claim 9 in which the packer has a circulating port in the mandrel above the upper packing element and further including the step of opening the circulating port in the mandrel above the packing elements after closing the injection/receiving ports to allow fluid to be pumped from the surface to remove excess acid, cement, or the like in the tubing above the circulating port, and closing the circulating port before releasing the packer.

11. The method of claim 10 in which the steps of opening the injection/receiving ports, closing the injection/receiving ports, and opening and closing the circulating ports are repeated before releasing the packing elements.

* * * * *